US011712706B2

(12) United States Patent
Kenter

(10) Patent No.: US 11,712,706 B2
(45) Date of Patent: Aug. 1, 2023

(54) ATOMIZER NOZZLE

(71) Applicant: Alfons Kenter, Halen (DE)

(72) Inventor: Alfons Kenter, Halen (DE)

( * ) Notice: Subject to any disclaimer, the term of this patent is extended or adjusted under 35 U.S.C. 154(b) by 0 days.

(21) Appl. No.: 16/623,296

(22) PCT Filed: Jun. 14, 2018

(86) PCT No.: PCT/EP2018/065768
§ 371 (c)(1),
(2) Date: Dec. 16, 2019

(87) PCT Pub. No.: WO2018/229177
PCT Pub. Date: Dec. 20, 2018

(65) Prior Publication Data

US 2020/0171516 A1 Jun. 4, 2020

(30) Foreign Application Priority Data

Jun. 15, 2017 (DE) ..... 102017113207.4

(51) Int. Cl.
*B05B 1/34* (2006.01)

(52) U.S. Cl.
CPC ..... *B05B 1/3426* (2013.01); *B05B 1/3431* (2013.01); *B05B 1/3436* (2013.01); *B05B 1/3463* (2013.01)

(58) Field of Classification Search
CPC ... B05B 1/3431; B05B 1/3442; B05B 1/3436; B05B 1/3463
USPC ..... 239/468
See application file for complete search history.

(56) References Cited

U.S. PATENT DOCUMENTS 4,260,110 A * 4/1981 Werding ..... B05B 7/0425 239/404
5,067,655 A * 11/1991 Farago ..... B05B 1/3442 239/124
5,152,463 A * 10/1992 Mao ..... B05B 1/3426 239/402
5,857,595 A * 1/1999 Nilson ..... B05B 11/3067 222/212
6,000,636 A * 12/1999 Huang ..... B05B 3/04 239/381
6,142,388 A 11/2000 Schwab
6,354,519 B1 * 3/2002 Kidooka ..... A61B 1/126 239/463
6,609,666 B1 * 8/2003 Blake ..... B05B 1/3436 239/533.13

(Continued)

FOREIGN PATENT DOCUMENTS

CN 1498137 A 5/2004
CN 2636987 Y 9/2004

(Continued)

*Primary Examiner* — Qingzhang Zhou
*Assistant Examiner* — Kevin Edward Schwartz
(74) *Attorney, Agent, or Firm* — Muncy, Geissler, Olds & Lowe, P.C.

(57) ABSTRACT

An atomizer nozzle for atomizing a fluid, in particular a liquid, including a nozzle opening, a spinning chamber and at least one delivery channel for feeding the fluid into the spinning chamber, at least one delivery channel extending into the spinning chamber via at least one inlet. The spinning chamber has a curved base which is curved away from the nozzle opening, and at least one delivery channel is oriented towards the base.

9 Claims, 2 Drawing Sheets

(56) References Cited

U.S. PATENT DOCUMENTS

| | | | | |
|---|---|---|---|---|
| 8,387,899 | B2 * | 3/2013 | Fortier | B01F 25/10 604/82 |
| 8,408,480 | B2 * | 4/2013 | Hull | B05B 7/10 239/602 |
| 8,640,976 | B2 * | 2/2014 | Micheli | B05B 1/34 239/463 |
| 8,746,595 | B2 * | 6/2014 | Margheritis | B05B 11/3004 239/483 |
| 9,138,753 | B1 | 9/2015 | Takahara | |
| 2008/0093392 | A1 * | 4/2008 | Abduljalil | B05B 1/3426 222/394 |

FOREIGN PATENT DOCUMENTS

| | | | |
|---|---|---|---|
| CN | 1853793 | A | 11/2006 |
| CN | 101242908 | A | 8/2008 |
| CN | 103817027 | A | 5/2014 |
| CN | 103987464 | A | 8/2014 |
| CN | 203778219 | U | 8/2014 |
| CN | 105344505 | A | 2/2016 |
| CN | 105435977 | A | 3/2016 |
| CN | 205701148 | U | 11/2016 |
| DE | 1500594 | B1 | 4/1970 |
| DE | 10138622 | C2 | 6/2003 |
| EP | 0904842 | A2 | 3/1999 |
| EP | 2108459 | A1 | 10/2009 |
| EP | 2583756 | A1 | 4/2013 |
| EP | 2628546 | A1 | 8/2013 |
| JP | 2001104490 | A | 4/2001 |
| JP | 2014031990 | A | 2/2014 |
| RU | 2271872 | C1 | 3/2006 |
| SU | 1026836 | A2 | 7/1983 |
| SU | 1086185 | A1 | 4/1984 |

* cited by examiner

ATOMIZER NOZZLE

BACKGROUND OF THE INVENTION

Field of the Invention

The invention relates to an atomizer nozzle for atomizing a fluid, in particular a liquid, having a nozzle opening, a rotation chamber and at least one supply channel for supplying the fluid into the rotation chamber, wherein at least one supply channel opens into the rotation chamber via at least one inlet opening.

Brief Description of the Related Art

The atomization of fluids, in particular liquids such as water, is used in a wide range of applications. During atomization or nebulization, a liquid is divided into fine droplets, i.e. into an aerosol, for example a mist, with the droplets being suspended in a carrier gas, for example air. The atomization or nebulization of water is used, for example, in fire protection, wherein the nebulized water is used to lower the temperature and displace oxygen. The nebulized water may also bind toxic exhaust gases. Water mists may also be used to bind dust and odors, provide cooling, improve the indoor climate, regulate humidity and comply with antistatic requirements. In agriculture, for example, nebulized water may be used for the adiabatic cooling of a barn. In facilities with high hygiene standards, nebulized disinfectants may be used for example for decontamination.

By way of example, DE 101 38 622 C2 discloses a nebulizer for atomizing a liquid, intended for nebulizing water for climate control in animal husbandry. The atomizer has a nozzle opening and a rotation chamber upstream of the nozzle opening, with a plurality of rotation channels that open approximately tangentially into the rotation chamber to cause the liquid to move rotationally, coaxial to the nozzle opening. To achieve the smallest possible droplet size, the water is put into rotational movement before nebulization.

To achieve optimal effectiveness of the atomizer, for example for use in air conditioning or for binding dust and dirt particles as well as for use in fire protection, it is necessary to divide the liquid into the smallest possible droplets.

SUMMARY OF THE INVENTION

The object of the invention is to furnish an atomizer nozzle for atomizing a fluid with which a smallest possible droplet size may be achieved.

The solution to this problem is an atomizer nozzle that has the features of the independent claim(s). Refinements and advantageous configurations are set forth in the dependent claim(s).

It is seen as essential to the invention that, in an atomizer nozzle for atomizing a fluid, in particular a liquid, having a nozzle opening, a rotation chamber and at least one supply channel for supplying the fluid into the rotation chamber, wherein at least one supply channel opens into the rotation chamber via at least one inlet opening, the rotation chamber has a curved floor, the floor is curved away from the nozzle opening, and at least one supply channel is directed toward the floor.

The atomizer nozzle has a rotation chamber in which the fluid to be atomized is set in rotation. The atomized fluid is preferably a liquid, for example water. Preferably, the cross-section of the rotation chamber is rotationally symmetrical, in particular circular. The liquid to be atomized is introduced into the rotation chamber via at least one, preferably two, supply channels. For this purpose, the rotation chamber has inlet openings through which the supply channels open into the rotation chamber. The supply channels are arranged tangentially to the cross-section of the rotation chamber, and open tangentially into the rotation chamber. In particular, in a projection on the plane of the cross-section of the rotation chamber, the supply channels run tangentially to the cross-section of the rotation chamber. Preferably, the supply channels are arranged in such a way that in a projection onto the cross-sectional plane, the flow directions of the liquid in the supply channels point in opposite directions. The inlet openings are preferably arranged evenly-distributed over the circumference of the cross-section of the rotation chamber. In particular, two inlet openings are arranged at a distance of half the circumference from each other. The liquid to be atomized is introduced at least approximately tangentially into the rotation chamber and the rotationally symmetrical cross-section of the rotation chamber causes the liquid to rotate coaxially with the nozzle opening. Because both supply channels open into the rotation chamber and the flow directions of the liquid in the supply channels are directed in opposite directions in the projection onto the cross-sectional plane, the two supply channels support the rotation of the liquid. The rotation chamber has a curved floor, which is arranged at the end of the rotation chamber facing away from the nozzle opening. The curvature of the floor, in this case, is directed away from the plane that the nozzle opening spans. The floor thus has a convex curvature in relation to the plane that the nozzle opening spans. The supply channels are arranged tangentially to the cross-section of the rotation chamber and also tangentially to the curvature of the floor.

The inlet openings are arranged facing toward the floor so that the liquid to be atomized is introduced into the rotation chamber in the direction of the floor. When introduced into the rotation chamber, the flow direction of the liquid to be atomized is thus directed toward the floor and facing away from the nozzle opening. For example, the curvature of the floor may be hemisphere-shaped. Here the point of intersection with the radius of the hemisphere may lie on the plane spanned at the height of the inlet opening. In particular, the reference point of the hemisphere lies on the center line of symmetry of the rotation chamber and the nozzle opening. Preferably, the floor has less curvature than a hemisphere. The rotation chamber may have conically tapering inner walls that run between the nozzle opening and the floor. The inlet openings of the supply channels are arranged in the region of the transition from the conical region of the rotation chamber to the curved floor of the rotation chamber. By supplying the fluid to be atomized into this region, in particular by introducing the fluid in the direction of the curved floor, a particularly good pressure distribution is ensured in the entire rotation chamber, as well as an acceleration of the supplied fluid toward the nozzle opening. When the liquid emerges from the nozzle opening, the high centrifugal force acting on the liquid molecules results in the liquid being well nebulized.

In one refinement of the invention, the rotation chamber has a conical profile at least in part and the rotation chamber broadens from the nozzle opening toward the inlet opening. The rotation chamber has a conical profile, and the walls of the rotation chamber taper from the nozzle opening toward the inlet openings of the supply channels. As a result, a liquid column may be formed with a very high rotational speed.

In particular, in this case, the axis of rotation coaxial to the nozzle opening, around which the liquid column rotates, has very high rotational speeds, because only very low friction forces act on it. The conically tapering side walls ensure that approximately constant pressure conditions are formed between the nozzle opening and the inlet openings of the supply channels, so that laminar, turbulence-free flow conditions may be generated as far as possible. In addition, the conically tapering side walls guide the rotating liquid column toward the nozzle opening. The flow velocity, in particular the rotational speed, of the liquid column increases toward the nozzle opening. This allows the liquid to be very finely nebulized even at a low liquid pressure.

In one refinement of the invention, at least one inlet opening is arranged in the region where the inside diameter of the rotation chamber is greatest. The inner walls of the rotation chamber may have a conical profile. The supply channels are arranged tangentially to the cross-section of the rotation chamber at least in one projection onto the plane that the cross-section spans. In addition, the supply channels are arranged tangentially to the curvature of the floor and have inlet openings in the inner wall of the rotation chamber. By arranging the inlet openings in the region of the largest inside diameter of the rotation chamber, i.e. at the rotation chamber's widest point, and by introducing the fluid in the direction of the floor, it is made possible for pressure to build up uniformly in the rotation chamber. Before the fluid to be atomized may exit the rotation chamber through the nozzle opening, it must pass through the entire rotation chamber.

In one refinement of the invention, at least one supply channel is arranged at least in part tangentially to the curvature of the curved floor. The curved floor of the rotation chamber has a curvature that is directed away from the nozzle opening.

The inlet channels are arranged tangentially to the cross-section of the rotation chamber, in a projection onto the plane spanned by the edge of the curved floor. In addition, the supply channels are arranged tangentially to the curvature of the curved floor. In particular, the supply channels and thus the inlet openings are oriented facing toward the floor, so that the liquid fed through the supply channels is introduced into the rotation chamber in the direction of the floor. The introduced liquid thus flows along the curved floor. By introducing the liquid in the direction of the floor and in particular as a result of the liquid flowing along the curved floor surface, it is made possible to convey the liquid toward the nozzle opening without disturbance. Due to the arrangement tangential to the cross-section of the rotation chamber, a rotational movement of the liquid as well as an acceleration toward the nozzle opening is achieved. This leads to a particularly fine atomization of the liquid when the liquid exits the nozzle opening.

In one refinement of the invention, the edges of the floor span a plane and this plane is arranged parallel to a plane that the nozzle opening spans. The edges of the floor are formed by the region where the curvature of the floor transitions into the convex profile of the rotation chamber. The edges of the curved floor span a plane that is arranged parallel to the plane the nozzle opening spans. By arranging the floor in this way relative to the nozzle opening, a uniform pressure distribution is provided in the rotation chamber and the curvature of the floor makes possible an acceleration of the supplied liquid.

In one refinement of the invention, at least a section of at least one supply channel runs obliquely to the plane that the edge of the floor region spans. The supply channels are arranged tangentially to the curvature of the floor region. The supply channels thus run at least in part obliquely to the plane that the edge of the floor region spans.

In one refinement of the invention, the atomizer nozzle is constructed in at least two parts, the atomizer nozzle has a floor part having the curved base and an opening part having the nozzle opening, and at least one supply channel is formed in the floor part. This two-part construction enables a modular assembly of the atomizer nozzle. The opening part having the nozzle opening may, for example, have a bore or other opening through which the nozzle opening is formed. The rotation chamber may be formed by a recess in the opening part, with conically tapering walls, that is in connection with the nozzle opening. In the case of a floor part, the curved floor of the atomizer nozzle may be formed for example by a recess, in particular a curved recess. The component with the floor recess is arranged relative to the opening part in such a way that the edges that delimit the recess and the edges of the conically tapering region of the rotation chamber connect to each other. In the floor part, the supply channels for supplying a liquid into the rotation chamber may be formed, for example, by holes that run obliquely to the plane that the edge of the floor recess spans.

In one embodiment of the invention, there is at least one supply channel in the form of a passage in the floor part. The floor part may be substantially cylindrical. The floor of the rotation chamber may be formed by a curved recess in one end face of the floor part. For example, the floor part may have passages in the end face that forms the floor region, and these may form the supply channels at least in part. For example, the passages may be bores that are arranged tangentially to the curvature of the floor and open into the recess in the floor region.

In one refinement of the invention, the atomizer nozzle has two conically tapering regions that are arranged between the plane that the edges of the floor span and the plane that the nozzle opening spans, and the two conically tapering regions have different cone angles. In this case, a hollow cylindrical region may emanate from the nozzle opening, and may abut a first conically tapering region of the rotation chamber that connects to a second conically tapering region. The first conically tapering region has a smaller angle of elevation than the second conically tapering region with respect to the plane that the nozzle opening spans. Arranging two conical regions makes possible a particularly uniform distribution of pressure in the rotation chamber.

In one refinement of the invention, the atomizer nozzle has at least one cylindrically tapering region and the cylindrically tapering region is formed between the nozzle opening and a conically tapering region. To connect a conically tapering region to the nozzle opening, the nozzle opening has a hollow cylindrical, i.e. sleeve-shaped, region. The cylindrical wall of the nozzle opening transitions into the conically tapering region of the rotation chamber.

In one refinement of the invention, the opening part is at least in part sleeve-shaped, the center line of symmetry of the nozzle opening coincides with the center line of symmetry of the sleeve-shaped region, the sleeve-shaped region is designed to accommodate the floor part at least in part, and at least one channel for supplying liquid is formed between the floor part and the opening part. The opening part having the nozzle opening may have a sleeve-shaped region into which the floor part, which is preferably substantially cylindrical in shape, may be inserted.

In the assembled state the center line of symmetry of the sleeve-shaped region corresponds with the center line of symmetry of the rotation chamber and the nozzle opening as well as with the center line of symmetry of the floor. Thus the floor of the rotation chamber, as well as the nozzle opening, may be arranged one below the other. A circumferential gap may be formed between the wall of the substantially cylindrical floor part and the inner wall of the sleeve-shaped region of the opening part, and through this gap, liquid may penetrate into the supply channel of the atomizer nozzle and thus may be introduced into the rotation chamber.

BRIEF DESCRIPTION OF THE DRAWINGS

In the following, the invention is explained at greater length with reference to an exemplary embodiment shown in the drawing. In particular, the drawings show the following schematic representations:

FIG. 1 shows a longitudinal section of an atomizer nozzle 1 according to the invention with a nozzle opening 2 and a rotation chamber 3. Supply channels for supplying liquid into the rotation chamber 3 open into the rotation chamber 3 via inlet openings 4. The inner walls of the rotation chamber 3 have a conical progression from the nozzle opening 2 in the direction of the inlet opening 4, and the rotation chamber 3 broadens in this direction. The rotation chamber 3 has a curved floor 5 that connects to the conical region. The floor 5 has a convex curvature in relation to the plane that nozzle opening 2 spans; in other words, the curvature is directed away from the nozzle opening 2.

DETAILED DESCRIPTION OF THE PREFERRED EMBODIMENTS

Figure 1:
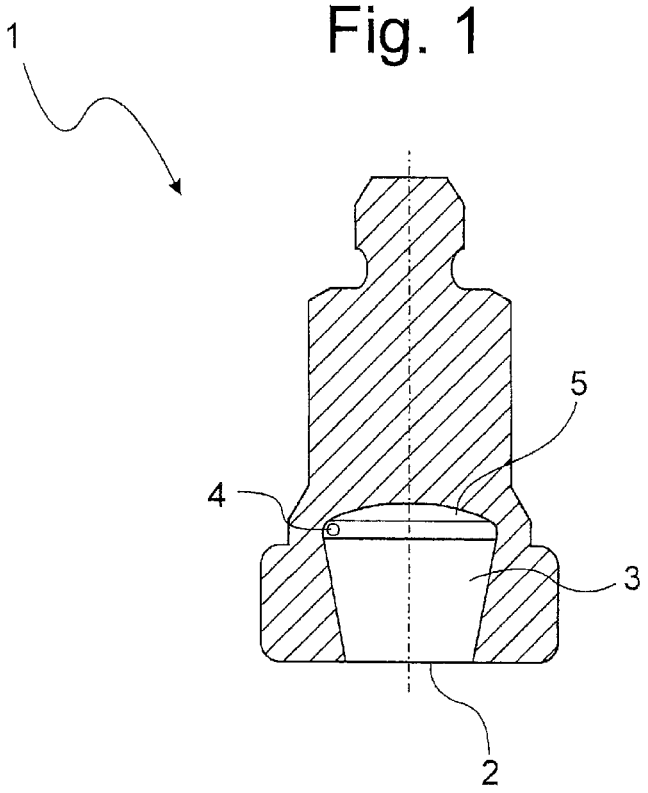
FIG. 1: a partially cut-away view of an atomizer nozzle.

The rotation chamber 3 has its greatest inside diameter between the floor region 5 and the conical region. The inlet opening 4 is arranged in this region. In a projection of the supply channels into the plane that the nozzle opening spans, the supply channels are arranged tangentially to the preferably circular cross-section of the rotation chamber 3. When a liquid, in particular water, is introduced, it is set in rotation in the rotation chamber 3 and accelerated toward the nozzle opening 2 by the convex curvature of the floor 5. When the rotating liquid emerges from the nozzle opening 2, the liquid is finely nebulized.

Figure 2:
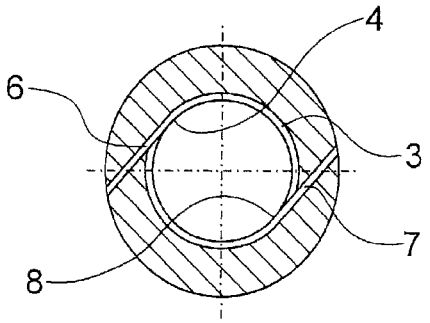
FIG. 2: a projection of the cross-section of an atomizer nozzle with two supply channels.

FIG. 2 shows a projection of an atomizer nozzle 1 onto the cross-sectional plane of the rotation chamber 3 of the atomizer nozzle 1. In a projection into this plane, the supply channels 6, 7 are arranged tangentially to the rotationally symmetrical cross-section of the rotation chamber 3. The supply channels 6, 7 open into the rotation chamber 3 via inlet openings 4, 8. In the projection, the flow direction of the liquid in the two supply channels 6, 7 is directed in the opposite direction, so that the direction of rotation of the liquid is supported by both supply channels 6, 7. The inlet openings 4, 8 are arranged at a distance of a half-circumference of the rotation chamber 3 from each other.

Figure 3:
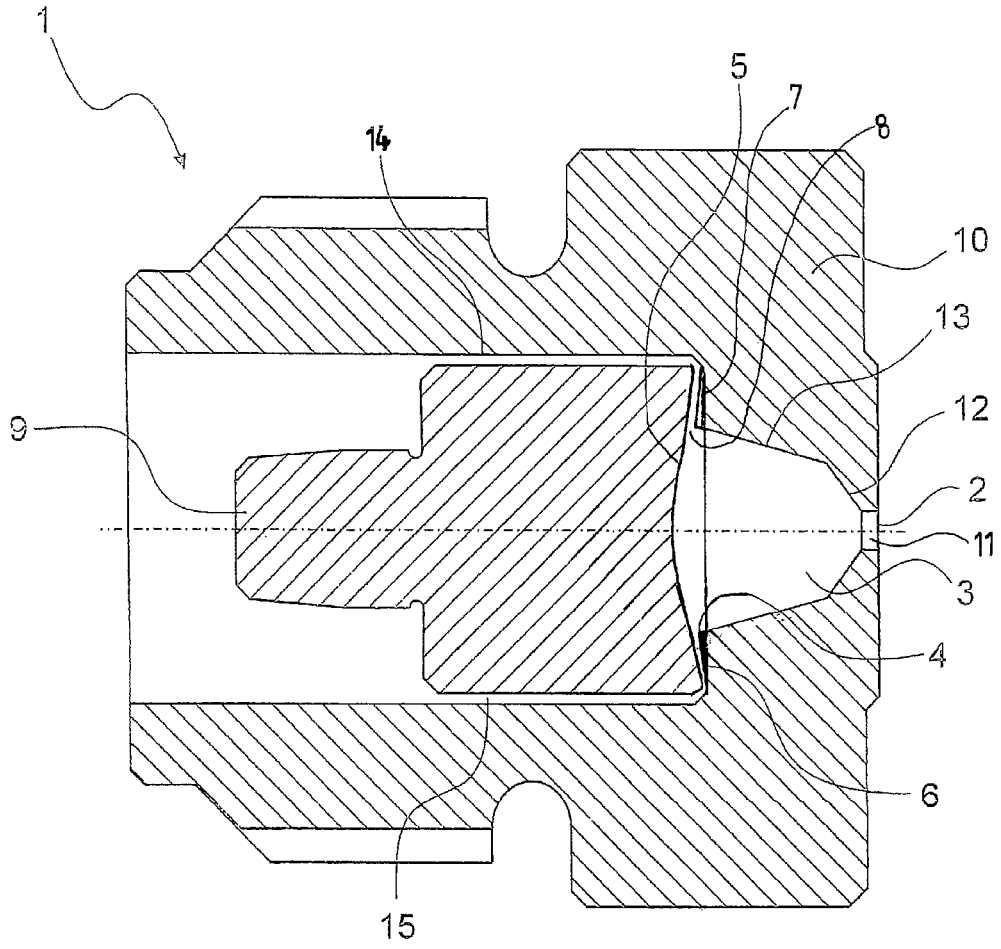
FIG. 3: a cut-away view of a two-part atomizer nozzle with an opening part and a floor part.

FIG. 3 shows a two-part atomizer nozzle 1 having a floor part 9 and an opening part 10. The opening part 10 has a nozzle opening 2, from which a cylindrical, sleeve-shaped region 11 branches off. The cylindrical region 11 connects to a first conical region 12 that transitions into a second conical region 13. The rotation chamber 3 is formed by the first conical region 12 and the second region 13. With respect to the plane that the nozzle opening 2 spans, the first conical region 12 has a smaller angle of inclination than the second conical region 13.

The second conical region 13 connects to the floor 5. The floor 5 is formed by a curved recess in the floor part 9. The radius at the greatest inside diameter of the rotation chamber 3 corresponds to the radius of the recess that forms the floor 5. At least one supply channel 6, 7 is formed in the floor part 9 for example by a passage. The supply channel 6 is for example formed by a bore in the floor part 9, with the bore being arranged at the end face of the substantially cylindrical floor part. The supply channels 6, 7 are directed toward the floor 5 and fit snugly against the curvature of the floor 5 as a result of being arranged tangentially to the curvature of the floor 5. The inlet openings 4, 8 are arranged facing toward the floor 5. In addition, the supply channels 6, 7 run tangentially to the circular cross-section of the rotation chamber 3, at least in one projection onto the plane that the edge of the base 5 of the rotation chamber 3 spans. The supply channels 6, 7 thus run obliquely to the plane that the edge of the base 5 spans. A liquid introduced into the rotation chamber 3 through the supply channels 6, 7 is thus directed in the direction of the nozzle opening, along the curved floor 5 and the inner wall of the rotation chamber 3. The rotationally symmetrical design of the rotation chamber 3 sets the liquid in rotation. The opening part 10 has a sleeve-shaped section 14 in which the floor part 9 is accommodated. The floor part 9 is substantially cylindrical. A gap 15 is formed between the outer walls of the floor part 9 and the walls of the sleeve-shaped region 14 of the opening part. The liquid to be atomized may penetrate through the gap 15 into the supply channel 6 and thus into the rotation chamber 3.

Any and all of the features mentioned in the above description and in the claims may be selected and combined with the features of the independent claim. The disclosure of the invention is therefore not limited to the described or claimed combinations of features; rather, all feature combinations that are useful in the context of the invention should be deemed disclosed.

The invention claimed is:

1. An atomizer nozzle for atomizing a fluid, having a nozzle opening, a rotation chamber and one or more supply channels for supplying fluid into the rotation chamber, wherein one supply channel of the one or more supply channels opens into the rotation chamber via one or more inlet openings, wherein the rotation chamber has a curved floor, wherein the floor is curved away from the nozzle opening, wherein an edge of the floor spans a plane, wherein an entirety of the floor has a concave curvature in relation to the plane that the edge of the floor spans, wherein at least one supply channel of the one or more supply channels is directed in a direction toward the floor, wherein the at least one supply channel of the one or more supply channels is arranged at least in part tangentially to a curvature of the floor, wherein the rotation chamber has a conical profile at least in part, and wherein at least one inlet opening of the one or more inlet openings is arranged in a region of a greatest inside diameter of the rotation chamber.

2. The atomizer nozzle according to claim 1, wherein the rotation chamber broadens from the nozzle opening toward at least one inlet opening of the one or more inlet openings.

3. The atomizer nozzle according to claim 1, wherein the plane that the edge of the floor spans is arranged parallel to a plane that the nozzle opening spans.

4. The atomizer nozzle according to claim 1, wherein the at least one supply channel of the one or more supply channels extends at least in part obliquely to the plane that the edge of the floor spans.

5. The atomizer nozzle according to claim 1, wherein the atomizer nozzle is constructed to have at least two parts, the atomizer nozzle has a first floor part that has the floor and an opening part that has the nozzle opening, and the at least one supply channel of the one or more supply channels is formed in the first floor part.

6. The atomizer nozzle according to claim 5, wherein the at least one supply channel of the one or more supply channels is formed at least in part in the form of a passage in the first floor part.

7. The atomizer nozzle according to claim 1, wherein the atomizer nozzle has two conically tapering regions that are arranged between the plane that the edge of the floor spans and a plane that the nozzle opening spans, and the two conically tapering regions have different cone angles.

8. The atomizer nozzle according to claim 1, wherein the atomizer nozzle has one or more cylindrical regions and the one or more cylindrical regions are formed between the nozzle opening and a conically tapering region.

9. The atomizer nozzle according to claim 5, wherein the opening part is designed to have a symmetrical cylinder region, the nozzle opening is symmetrical, a center line of symmetry of the nozzle opening corresponds to a center line of symmetry of the symmetrical cylinder region of the opening part, the symmetrical cylinder region of the opening part is designed to accommodate the first floor part at least in part, and at least one gap is designed between the first floor part and the opening part for supplying liquid.

* * * * *